US005224966A

United States Patent [19]

Kroneis et al.

[11] Patent Number: 5,224,966

[45] Date of Patent: Jul. 6, 1993

[54] PROCESS FOR SINGLE-BATH DYEING AND FLAMEPROOFING OF TEXTILE SHEET MATERIALS USING DISPERSE DYE AND HALOGEN-FREE PHOSPHORUS-CONTAINING FLAME RETARDANT

[75] Inventors: Alfred Kroneis, Augsburg; Hans Beiertz, Waldems, both of Fed. Rep. of Germany

[73] Assignee: Hoechst Aktiengesellschaft, Fed. Rep. of Germany

[21] Appl. No.: 665,364

[22] Filed: Mar. 6, 1991

[30] Foreign Application Priority Data

Mar. 8, 1990 [DE] Fed. Rep. of Germany ..... 4007299

[51] Int. Cl.[5] ..... C09K 21/12; D06M 13/28; D06P 1/66; D06P 3/54

[52] U.S. Cl. ..... 8/490; 8/524; 8/584; 8/636; 8/922

[58] Field of Search ..... 8/490, 584

[56] References Cited

U.S. PATENT DOCUMENTS

| | | | |
|---|---|---|---|
| 3,922,406 | 11/1975 | Chapin | 8/115.7 |
| 3,941,752 | 3/1976 | Kleiner et al. | 528/287 |
| 4,033,936 | 7/1977 | Bollert et al. | 528/287 |
| 4,066,812 | 1/1978 | Kaupin | 8/115.61 |
| 4,113,429 | 9/1978 | Kruse et al. | 8/524 |
| 4,340,388 | 7/1982 | Kowalski | 8/584 |
| 4,752,300 | 6/1988 | Johnson | 8/584 |
| 4,842,609 | 6/1989 | Johnson | 8/115.7 |
| 4,902,300 | 2/1990 | Johnson et al. | 8/532 |
| 4,918,122 | 4/1990 | Dellar et al. | 524/95 |

*Primary Examiner*—A. Lionel Clingman
*Attorney, Agent, or Firm*—Connolly & Hutz

[57] ABSTRACT

There is described a process for the simultaneous dyeing and flameproofing of textile sheet materials made of polyester fibers by padding or printing the textile material with a dye preparation, partially or completely drying the treated textile material and then heat treating it, which comprises using a dye preparation which contains one or more disperse dyes and one or more flame retardants based on halogen-free phosphoric and/or phosphonic acid derivatives with or without thickeners and/or foam-forming agents. The disperse dyes used are thermosol dyes.

9 Claims, No Drawings

PROCESS FOR SINGLE-BATH DYEING AND FLAMEPROOFING OF TEXTILE SHEET MATERIALS USING DISPERSE DYE AND HALOGEN-FREE PHOSPHORUS-CONTAINING FLAME RETARDANT

The present invention relates to a process for the single-bath dyeing and flameproofing of textile sheet materials made wholly or predominantly of polyester fibers.

Textile sheet materials made of polyesters, for example polyethylene terephthalate, have inherent low-flammability properties. To meet more stringent low-flammability requirements, it is known not only to apply flameproofing finishes but also to use polyester raw materials which have been modified to be flame-resistant, for example as described in German Patent 2,346,787.

Similarly, bonded fiber webs made of polyester fibers are inherently flame-resistant if they have been consolidated purely mechanically, i.e. by needling, or thermally, for example with binder fibers. The flame-resistance of these polyester webs may also be increased still further by using flame-resistant binder fibers.

If, however, the inherently flame-resistant polyester textiles are dyed with disperse dyes in a conventional manner, it is found in general that the flammability increases, so that the dyed materials can no longer be used for many purposes where low flammability of the textile material is important.

As regards blends of polyester and cellulose it is already known from WO 88/9411 to apply a flame retardant to the fiber material as part of the dyeing process. However, owing to the fundamental differences in the chemical structures of cellulose fibers and polyesters, textile finishing processes which are suitable for the treatment of cellulose textiles cannot be used for polyester materials.

German Offenlegungsschrift 2,400,191 describes a process of simultaneous dyeing and flameproofing which, however, uses pigment dyes. But pigment dyeings in general do not have high crock fastness properties, so that textiles which have been dyed by this process frequently do not meet the fastness standards expected by demanding users.

It is an object of the present invention to specify a process for the simultaneous dyeing and flameproofing of textile sheet materials made wholly or predominantly of polyester fibers whereby it is possible to produce, on such textile materials, dyeings which meet high color fastness requirements and which guarantee low flammability even after the dyeing process.

This object is achieved by a novel process for the simultaneous dyeing and flameproofing of textile sheet materials made wholly or predominantly of polyester fibers by padding or printing the textile material with a dye preparation, partially or completely drying the treated textile material and then heat treating it, which comprises using a dye preparation which contains one or more disperse dyes, one or more flame retardants based on halogen-free phosphoric and/or phosphonic acid derivatives with or without thickeners and/or foam-forming agents, the thickeners being removable in the further course of the process by application of heat.

The textile materials to be treated should be made wholly or predominantly of polyester fibers; that is, they should contain at least 85%, preferably 100%, of polyester fibers. For the purposes of the present invention the term polyester fibers includes both staple fibers and continuous filaments, and they can be in the form of yarns, i.e. spun yarns or filament yarns, or else in the form of individual filaments. Textile sheet materials which can be processed according to the present invention can therefore be woven or knitted fabrics in which the fiber materials are present in the form of yarns, or else they can be bonded webs made of staple fibers or continuous filaments (spunbondeds). The process is particularly suitable for processing bonded fiber web materials, in particular spunbondeds.

The dye preparation is applied in a conventional manner, either by impregnating the entire textile material, for example by slop or face padding or by jet application, or—if a nonuniform design is desired—by local application of the dye preparation in a conventional textile printing process. After the dye preparation has been applied, the treated textile material is in general dried partially or completely and then subjected to a heat treatment at 180°-240° C., preferably at 200°-b 215° C. The medium for heating the textile material can be hot air or superheated steam, but the heat may also be supplied as contact heat.

The dye preparation to be used according to the present invention comprises an aqueous mixture of the active substances, which are present therein partly in a dissolved state, partly in a finely divided state. The dyes present in the dye preparation are finely divided disperse dyes which are suitable for dyeing polyester materials by the thermosol process (thermosol dyes). Suitable dyes may easily be discerned from the Colour Index tables. Examples of suitable dyes are ®Samaron Black HBBL 400, Colour Index Disperse Yellow 54, Colour Index Disperse Blue 56, ®Samaron Blue FBL and Colour Index Disperse Red 60.

The dye preparation may if desired be applied to the textile substrate in a conventional manner with foam-forming agents. Such foam-forming agents are commercially available.

If the dye preparation is to be applied by printing, the mixture should contain thickeners which are removable in the further course of the process by application of heat. Examples thereof are thickeners based on oil in water emulsions such as VARSOl® or WHITE SPIRIT®. Typical thickeners contain about 70-80% by weight of oil, 20-30% by weight of water and about 1% by weight of emulsifier, such as SOLEGAL®W. The viscosities of customary thickeners are about 20-30 poise at room temperature. The amount of thickener to be used can be determined by the person skilled in the art in a conventional manner so that crisp prints are obtained.

Prints may be produced in a conventional manner, for example by transfer printing, flat screen printing or roller screen printing. For transfer printing the right paper must be used. Transfer printing papers must be free of silicone and transferable oils.

The dye preparation to be used according to the present invention further contains one or more flame retardants based on halogen-free phosphoric or phosphonic acid derivatives, in particular the esters of these acids. Such flame retardants are known. A review may be found for example in Kirk-Othmer, Encyclopedia of Chemical Technology, 3rd ed., vol. 10, pp. 406. Particularly advantageous flame retardants for the process according to the present invention are derivatives of methylphosphonic acid. A commercial product which is particularly suitable for the process is the flame retardant ®Flacavon AZ from Schill & Seilacher.

The disperse dyes are in general present in the dye preparations to be used according to the present invention in an amount of from 0.6 to 30 g/kg, preferably from 3 to 20 g/kg of dye preparation. Within this weight range the person skilled in the art should select the amount of dye for a specific case according to the criterion that a wet pickup of from about 25 to 200%, in particular 25 to 80%, or a conventional printing process will produce a dye concentration in the material of from about 0.1 to 0.2% by weight of dye, on weight of fiber, in the case of very pale dyeings and from about 1 to 3% by weight of dye, on weight of fiber, for deep to very deep dyeings.

The flame retardant is present in the dye preparation to be used according to the present invention in an amount of from 100 to 200 g/l, preferably from 130 to 180 g/l, of preparation. The most suitable amount in the particular case depends on the amount of dye present in the preparation. In the case of light-colored dyeings with from 0.1 to 0.2% by weight of dye on weight of fiber, the amount of flame retardant is advantageously selected from the lower end of the specified range; that is, it will be from 100 to 150, preferably from 130 to 150, g/l, whereas in the case of deep dyeings with from 1 to 3% by weight of dye per 100 kg of textile material the dye preparation advantageously contains from 150 to 200, preferably from 150 to 180, g/l of flame retardant.

In a preferred embodiment the dye preparation to be used according to the present invention contains from 0.6 to 30 g/l of one or more disperse dyes and in addition from 100 to 200 g/l, preferably 130 to 180 g/l, of one or more flame retardants.

The amount of flame retardant on the surface of the textile materials should be for example 5–30% by weight, on weight of fiber, but in particular 10–20% by weight.

On application of such a dye preparation in the amount required for the desired depth of shade, the resulting add-on of flame retardant will vary from 5 to 20% by weight, based on the weight of the dry textile material, as a function of the depth of shade.

In a further particularly preferred embodiment of the process according to the present invention, the textile material to be processed is subjected to a thorough cleaning operation before it is subjected to the dyeing and finishing process of the present invention.

With this upstream cleaning operation—i.e. upstream of the actual finishing process according to the present invention—care must be taken to ensure that all traces of spin and lubricating finishes which may be present on the textile sheet materials are removed.

We claim:

1. A process for the simultaneous dyeing and flameproofing of textile sheet materials made wholly or predominantly of polyester fibers by padding or printing the textile material with a dye preparation, partially or completely drying the treated textile material and then heat treating it, which comprises using a dye preparation which contains one or more disperse dyes in an amount of from 0.6 to 30 g/l, one or more flame retardants based on halogen-free phosphoric and/or phosphonic acid derivatives in an amount of from 100 to 200 g/l with or without thickeners and/or foam-forming agents, the thickeners being removable in the further course of the process by application of heat.

2. The process of claim 1 wherein the amount of dye preparation to be applied to the textile material is chosen in such a way as to produce a flame retardant add-on of 10–20% by weight on weight of fiber.

3. The process of claim 1 wherein the disperse dye is a thermosol dye.

4. The process of claim 1 wherein the flame retardant is a halogen-free phosphoric and/or phosphonic ester.

5. The process of claim 1 wherein the flame retardant is a halogen-free derivative of methylphosphonic acid.

6. The process of claim 1 wherein the textile sheet material is made at least 85%, of polyester fibers.

7. The process of claim 1 wherein the textile sheet material is a bonded fiber web.

8. The process of claim 1 wherein the textile sheet material is thoroughly cleaned prior to the combined dyeing/finishing treatment of claim 7.

9. The process of claim 6, wherein the textile sheet material is 100% of polyester fibers.

* * * * *